US009264812B2

(12) United States Patent
Someda

(10) Patent No.: US 9,264,812 B2
(45) Date of Patent: Feb. 16, 2016

(54) APPARATUS AND METHOD FOR LOCALIZING A SOUND IMAGE, AND A NON-TRANSITORY COMPUTER READABLE MEDIUM

(71) Applicant: KABUSHIKI KAISHA TOSHIBA, Minato-ku, Tokyo (JP)

(72) Inventor: Keiichiro Someda, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 336 days.

(21) Appl. No.: 13/716,907

(22) Filed: Dec. 17, 2012

(65) Prior Publication Data

US 2013/0336490 A1 Dec. 19, 2013

(30) Foreign Application Priority Data

Jun. 15, 2012 (JP) ..... 2012-136407

(51) Int. Cl.
*H04R 5/00* (2006.01)
*H04S 7/00* (2006.01)
*H04S 3/02* (2006.01)

(52) U.S. Cl.
CPC .. *H04R 5/00* (2013.01); *H04S 7/30* (2013.01); *H04S 3/02* (2013.01); *H04S 2420/01* (2013.01)

(58) Field of Classification Search
CPC ..... H04R 5/02; H04R 5/00; H04R 3/005; H04S 2420/01; H04S 7/30; H04S 7/00
USPC ..... 381/17, 18, 310, 111, 121, 1; 700/94
See application file for complete search history.

(56) References Cited

U.S. PATENT DOCUMENTS

| | | | | |
|---|---|---|---|---|
| 6,035,045 | A * | 3/2000 | Fujita et al. | 381/17 |
| 2001/0040968 | A1 * | 11/2001 | Mukojima | 381/17 |
| 2003/0118192 | A1 | 6/2003 | Sasaki | |
| 2005/0271212 | A1 | 12/2005 | Schaeffer et al. | |

(Continued)

FOREIGN PATENT DOCUMENTS

| | | | |
|---|---|---|---|
| CN | 1419796 | A | 5/2003 |
| CN | 101361123 | | 2/2009 |
| JP | 10-174200 | A | 6/1998 |

OTHER PUBLICATIONS

Chinese First Office Action dated Dec. 4, 2014 from corresponding CN Patent Application No. 2013100336535, 11 pages.
Chinese Office Action for Chinese Patent Application No. 201310033653.5 mailed on Aug. 4, 2015.

*Primary Examiner* — Vivian Chin
*Assistant Examiner* — Ubachukwu Odunukwe
(74) *Attorney, Agent, or Firm* — Amin, Turocy & Watson, LLP

(57) ABSTRACT

According to one embodiment, a sound localization apparatus includes a storage unit, a selection unit, and a first operation unit. The storage unit stores a plurality of acoustic transfer characteristics each corresponding to a sound image direction and an emphasis degree of feeling of localization. The selection unit is configured to select a suitable acoustic transfer characteristic from the plurality of acoustic transfer characteristics. The suitable acoustic transfer characteristic is most suitable for the sound image direction indicated by a direction indication information and the emphasis degree indicated by an emphasis degree indication information. The first operation unit is configured to convolute the suitable acoustic transfer characteristic with a first audio signal to obtain a second audio signal.

6 Claims, 11 Drawing Sheets

(56) References Cited

U.S. PATENT DOCUMENTS

2008/0219454 A1* 9/2008 Iida et al. ..... 381/17
2009/0043423 A1* 2/2009 Sugiyama et al. ..... 700/245
2010/0185308 A1* 7/2010 Yoshida et al. ..... 700/94
2010/0222904 A1* 9/2010 Yamashita et al. ..... 700/94
2011/0116638 A1* 5/2011 Son et al. ..... 381/1

* cited by examiner

APPARATUS AND METHOD FOR LOCALIZING A SOUND IMAGE, AND A NON-TRANSITORY COMPUTER READABLE MEDIUM

CROSS-REFERENCE TO RELATED APPLICATION

This application is based upon and claims the benefit of priority from Japanese Patent Application No. 2012-136407, filed on Jun. 15, 2012; the entire contents of which are incorporated herein by reference.

FIELD

Embodiments described herein relate generally to an apparatus and a method for localizing a sound image, and a non-transitory computer readable medium.

BACKGROUND

By using an acoustic replay device such as a loud speaker or a head phone, a stereophonic acoustic technique to localize a sound image (as a virtual sound source) at an arbitrary (frontward and rearward, leftward and rightward) position of a listener is well known.

As to a sound localization apparatus of conventional stereophonic acoustic technique, a head-related transfer function (from a desired position to localize the sound image to both ears of the listener) is convoluted with an audio signal, and the audio signal is presented to the listener. As a result, the sound image can be localized at the desired position.

In this sound localization apparatus used for the acoustic replay apparatus, realization of a function to adjust an emphasis degree of feeling of localization (to be presented to the listener) based on the listener's liking is desired.

However, in order to adjust the emphasis degree of feeling of localization for the listener, it is insufficient that a sound pressure at the listener's ears (when a sound source really exists) is accurately reappeared by using the head-related transfer function. In localization processing of the sound image based on the head-related transfer function, a factor to affect on the emphasis degree of feeling of localization is not clear, and the emphasis degree of feeling of localization of the sound image is difficult to be adjusted.

DETAILED DESCRIPTION

According to one embodiment, a sound localization apparatus includes a storage unit, a selection unit, and a first operation unit. The storage unit stores a plurality of acoustic transfer characteristics each corresponding to a sound image direction and an emphasis degree of feeling of localization. The selection unit is configured to select a suitable acoustic transfer characteristic from the plurality of acoustic transfer characteristics. The suitable acoustic transfer characteristic is most suitable for the sound image direction indicated by a direction indication information and the emphasis degree indicated by an emphasis degree indication information. The first operation unit is configured to convolute the suitable acoustic transfer characteristic with a first audio signal to obtain a second audio signal.

Various embodiments will be described hereinafter with reference to the accompanying drawings.

The First Embodiment

Figure 1:
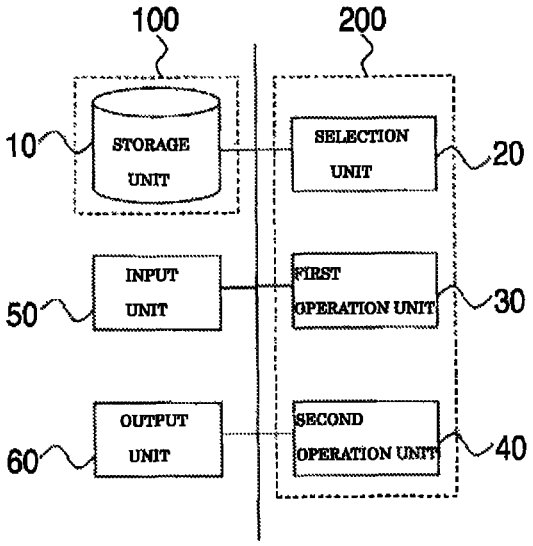
FIG. 1 is a block diagram of a sound localization apparatus according to a first embodiment.

FIG. 1 is a block diagram of the sound localization apparatus according to the first embodiment. In following explanation, a direction along which the listener turns is defined as "front", and a reverse direction of the direction along which the listener turns is defined as "rear". Furthermore, a left side direction toward the direction along which the listener turns is defined as "left", and a right side direction toward the direction along which the listener turns is defined as "right". For example, the case that the listener enjoys listening tunes by a headphone is imagined. In this sound localization apparatus, a sound image is localized along the listener's desired direction and the listener can adjust a degree of feeling of localization of the sound image.

In FIG. 1, the sound localization apparatus includes an input unit 50 and a storage unit 10. The input unit 50 is used for the listener to indicate a direction (sound image direction) to localize the sound image, and a degree (emphasis degree) of emphasis of feeling of localization of the sound image. Based on information to indicate the sound image direction and the emphasis degree from the input unit 50, a selection unit 20 selects one most matched with the sound image direction and the emphasis degree from a plurality of acoustic transfer characteristics. The acoustic transfer characteristic selected is called "an indicated acoustic transfer characteristic". A first operation unit 30 convolutes the indicated acoustic transfer characteristic with an audio signal (first audio signal). As a result, the audio signal (second audio signal) to which a frontward and rearward localization information and the emphasis degree are added is obtained.

Furthermore, a second operation unit 40 assigns an interaural level difference and an interaural time difference to the second audio signal. Here, the interaural time difference may be an interaural phase difference. As a result, an audio signal (third audio signal and fourth audio signal) to which leftward and rightward localization information is added is obtained. An output unit 60 outputs the third audio signal and the fourth audio signal to the listener.

Moreover, as the storage unit 10, for example, a storage device 100 such as a memory or a HDD is used. Furthermore, as the selection unit 20, the first operation unit 30 and the second operation unit 40, for example, an operation processing device 200 such as a CPU is used. Furthermore, the input unit 50 is, for example, a remote controller. The output unit 60 is, for example, a headphone or an earphone.

In order to reappear a stereophonic acoustic, a frontward and rearward sound localization, and a leftward and rightward sound localization, need to be realized. The frontward and rearward sound localization, and the leftward and rightward sound localization, can be independently controlled.

As to the frontward and rearward sound localization, an acoustic transfer characteristic of human's pinna is largely related. Briefly, the pinna collects sounds coming from the front, and amplifies the sounds. On the other hand, the pinna screens sounds coming from the rear, and attenuates the sounds. When a human hears sounds, due to existence of the pinna, difference of the acoustic transfer characteristic occurs in sounds coming from the front and the rear. Accordingly, by deciding difference of the acoustic transfer characteristics of the front and the rear by the sense of hearing, the frontward and the rearward sound localization can be accomplished.

In the first embodiment, as an acoustic transfer characteristic to imitate the acoustic transfer characteristic of the pinna, a plurality of acoustic transfer characteristics each corresponding to a sound image direction and an emphasis degree is used. Here, the sound image direction represents, for example, if the front of the listener is 0° by centering around the listener, a direction to localize the sound image, i.e., a direction for the listener to hear a virtual sound. Furthermore, the emphasis degree represents, for example, if the sound image direction variously changes, a change amount of a sound pressure level of the sound heard.

As explained afterwards, this level of the emphasis degree is corresponded to a frequency of a dip positioned at the lowest frequency side of the acoustic transfer characteristic. Briefly, by using a plurality of acoustic transfer characteristics of which frequencies of dips are different, for example, the level of the emphasis degree can be adjusted to match with the listener's liking. Moreover, the dip is a region where a gain drops in comparison with other gains of adjacent frequencies. Briefly, a frequency of the dip is one of a peak convex downward positioned at the lowest frequency side of the acoustic transfer characteristic.

This acoustic transfer characteristic can be created, for example, by using an acoustic transfer characteristic obtained from a screening plate. Briefly, by convoluting an acoustic transfer characteristic (selected from the plurality of acoustic transfer characteristics) with the first audio signal, the second audio signal to which the (listener's desired) frontward and rearward localization information is assigned can be generated.

Hereinafter, an acoustic transfer characteristics of a screening plate used for the sound localization apparatus of the first embodiment is explained in detail.

The screening plate is a thin plate imitated as a human's pinna. The screening plane had better not be easily transformed and not transmit sound waves. Accordingly, a plate having a suitable thickness and made by material such as wood, metal or plastic, can be used. As a shape of the screening plate, a simpler shape is desirable, for example, a circular plate can be used. Furthermore, a size of the screening plate can be arbitrarily determined based on a standard size of a human's pinna. In this case, as definition of the size, for example, a typical length (in case of the circular plate, a diameter thereof) on a surface of the screening plate, or a projected area (cross-section area) on a plane perpendicular to the anteroposterior axis, can be used. As explained afterwards, a frequency of the dip corresponding to the level of the emphasis degree depends on the size of the screening plate.

Hereinafter, a method for measuring the acoustic transfer characteristic of the screening plate is explained.

Figure 11:
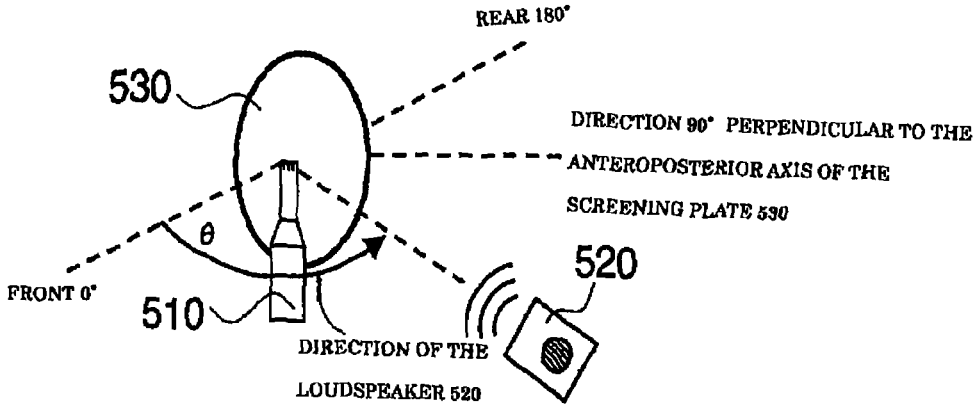
FIG. 11 is a schematic diagram of a device for measuring the acoustic transfer characteristic.

FIG. 11 is a schematic diagram of a measurement device to measure the acoustic transfer characteristic of the screening plate. In FIG. 11, the measurement device includes a microphone 510 having a sound receiving point adjacent to a center on a surface of a circular screening plate 530, and a loudspeaker 520 remotely positioned as a predetermined distance from the center of the screening plate 530. Moreover, as a direction θ of the loudspeaker 520 from a direction normal to the surface of the screening plate 530, by defining a direction (the normal direction) of the front side (side of the microphone 510) of the screening plate 530 as the front 0°, a direction perpendicular to the anteroposterior axis of the screening plate 530 is set to 90°, and a direction of the back side (reverse side of the microphone 510) of the screening plate 530 is set to the rear 180°.

In the acoustic transfer function from the loudspeaker 520 to the microphone 510 under a condition that the screening plate 530 is located, information to imitate the acoustic transfer characteristic of the pinna, i.e., information for the listener to recognize the sound image along frontward and rearward direction (frontward and rearward localization information), is included. Furthermore, information of an attenuation of amplitude and a time delay when a sound propagates from a sound image position to the listener's position, i.e., information for the listener to recognize the sound image along leftward and rightward direction (leftward and rightward localization information), is included. However, the leftward and rightward localization information is also included in signals used for the leftward and rightward sound localization (explained afterwards). Accordingly, in case of the frontward and rearward sound localization, the leftward and rightward localization information should be removed from the acoustic transfer function in order not to be doubly applied.

As a result, the acoustic transfer characteristic of the screening plate 530 is calculated as a ratio of "the acoustic transfer function from the loudspeaker 520 to the microphone 510 under a condition that the screening plate 530 is located" to "the acoustic transfer function from the loudspeaker 520 to the microphone 510 under a condition that the screening plate 530 is not located". Briefly, the acoustic transfer characteristic of the screening plate 530 is calculated by following equation.

$$H = \frac{H_a}{H_0} \tag{1}$$

H: the acoustic transfer characteristic of the screening plate $H_0$: the acoustic transfer function from the loudspeaker to the microphone under a condition that the screening plate is not located $H_a$: the acoustic transfer function from the loudspeaker to the microphone under a condition that the screening plate is located As to sounds coming from the direction θ of the loudspeaker 520, the acoustic transfer characteristic of the screening plate 530 represents how the acoustic transfer function changes by existence or nonexistence of the screening plate 530. As a result, the acoustic transfer characteristic of the pinna can be imitated.

By using the measurement device of FIG. 11, acoustic transfer functions $H_0$ and $H_a$ from the loudspeaker 520 to the microphone 510 are calculated. For example, in both cases that the screening plate 530 is located and the screening plate 530 is not located, a white noise is radiated from the loudspeaker 520 located at the direction θ. A transfer function between a voltage signal inputted to the loudspeaker 520 and a sound pressure signal outputted from the microphone 510 is calculated by frequency analysis of an operation processing device. Then, the operation processing device calculates an acoustic transfer characteristic of the screening plate 530 by the equation (1). In this way, the acoustic transfer characteristic of the screening plate 530 is measured for each (different) direction θ of a plurality of loudspeakers 520 and each (different) size of a plurality of screening plates 530. Here, the direction θ of the loudspeaker 520 corresponds to a sound image direction.

Figure 2:
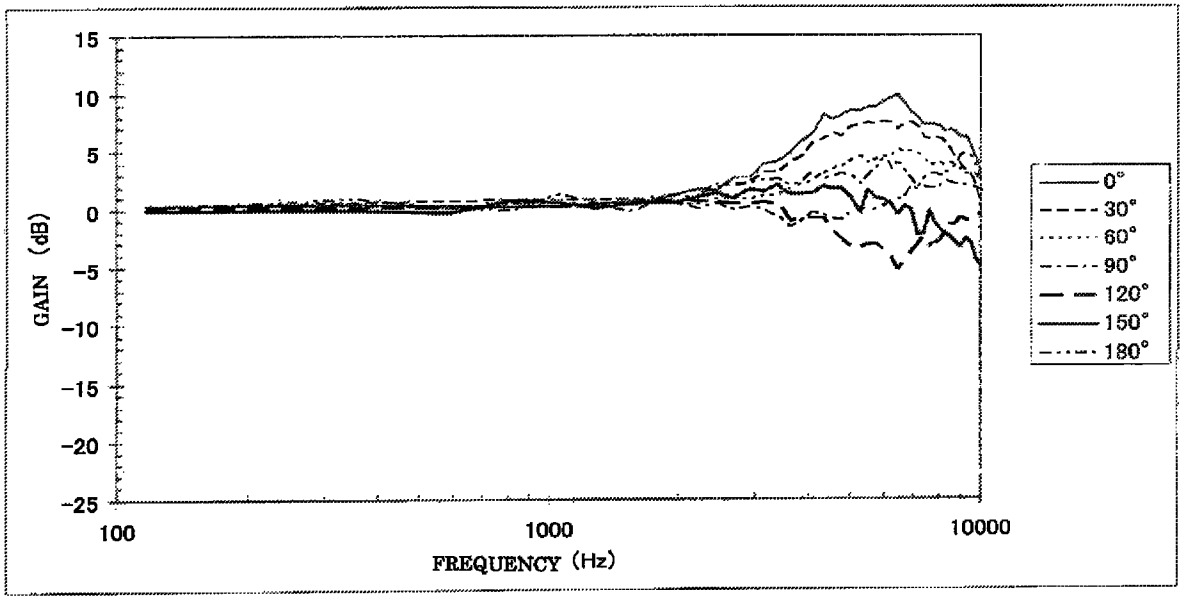
FIG. 2 is a graph showing a first example of an acoustic transfer characteristic according to the first embodiment.
Figure 3:
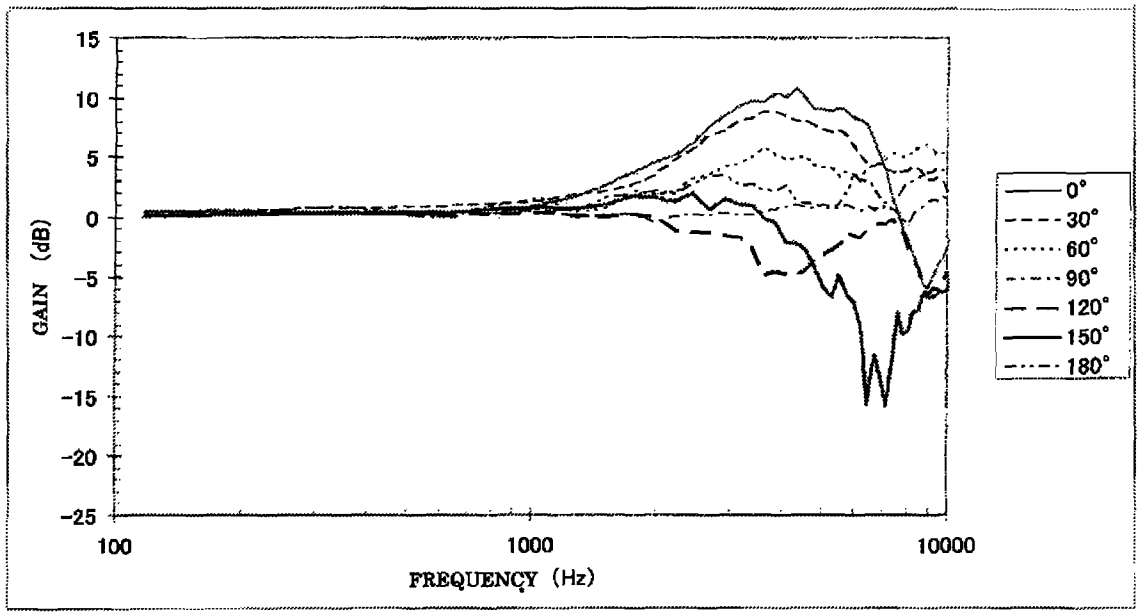
FIG. 3 is a graph showing a second example of the acoustic transfer characteristic according to the first embodiment.
Figure 4:
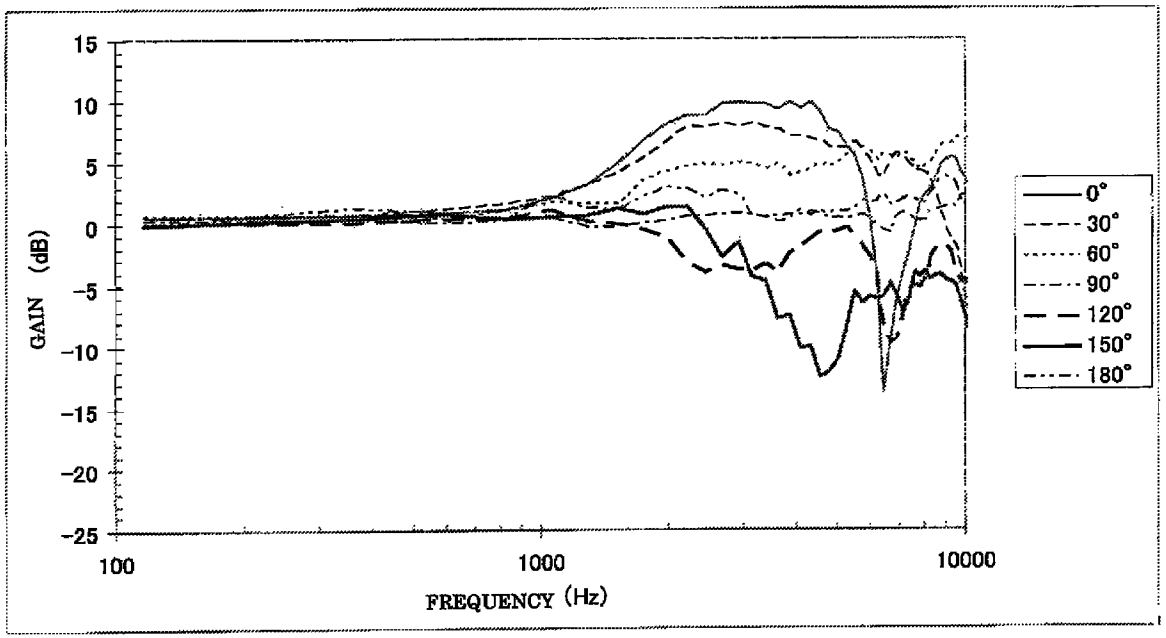
FIG. 4 is a graph showing a third example of the acoustic transfer characteristic according to the first embodiment.
Figure 5:
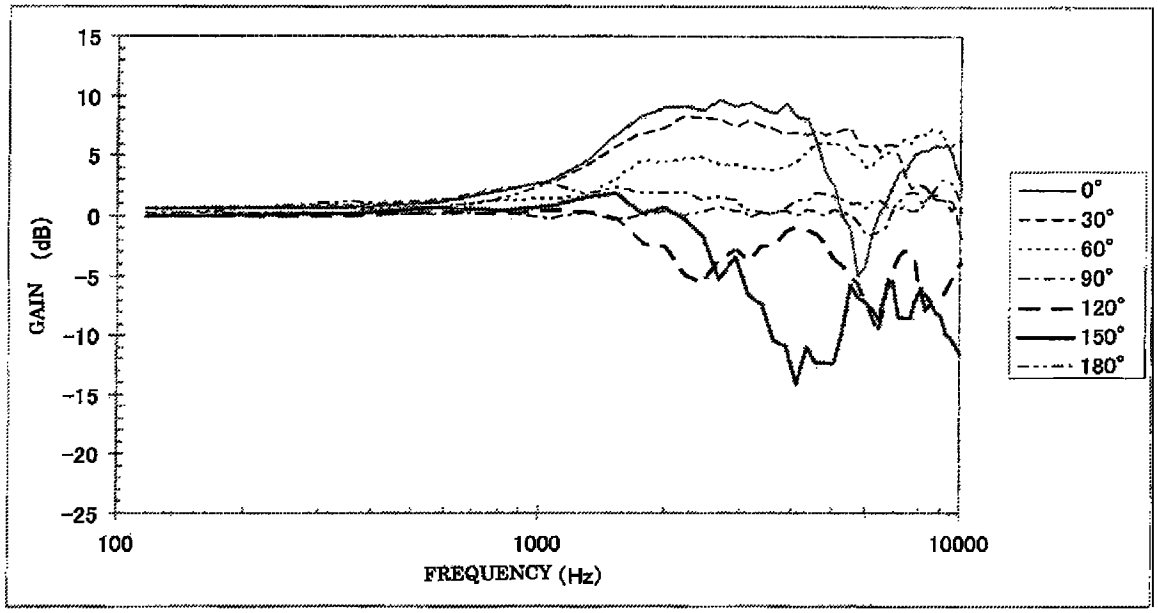
FIG. 5 is a graph showing a fourth example of the acoustic transfer characteristic according to the first embodiment.
Figure 6:
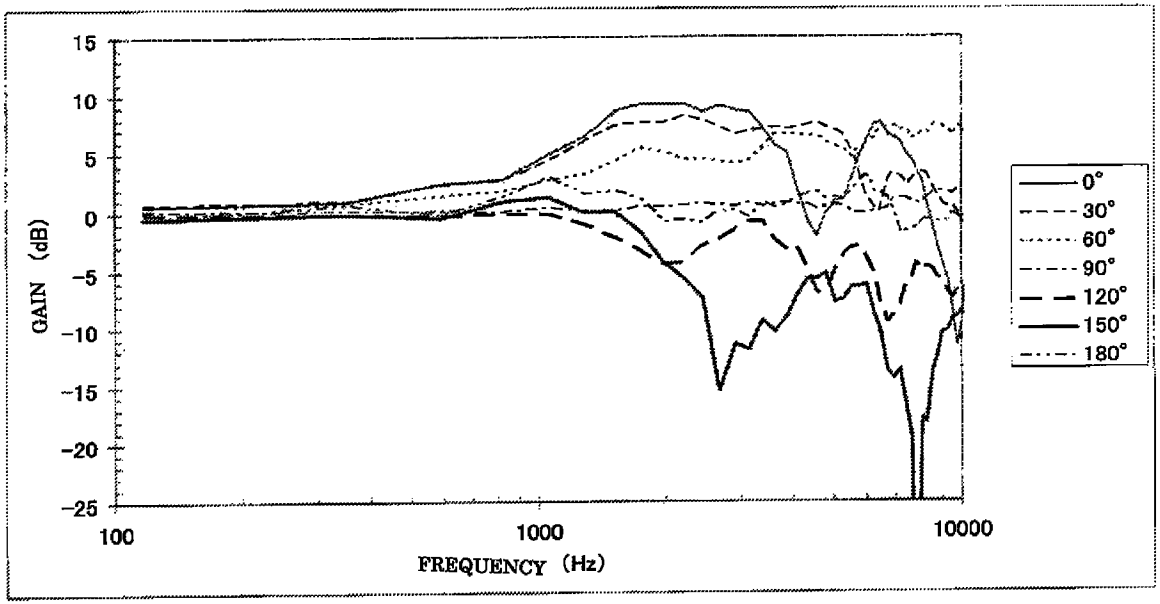
FIG. 6 is a graph showing a fifth example of the acoustic transfer characteristic according to the first embodiment.

FIGS. 2~6 show examples of the acoustic transfer characteristics of the screening plate 530. FIG. 2 shows a measurement result of the acoustic transfer characteristic of the screening plate 530 by using a circular screening plate having a diameter "4 cm". FIG. 3 shows a measurement result of the acoustic transfer characteristic of the screening plate 530 by using a circular screening plate having a diameter "7 cm". FIG. 4 shows a measurement result of the acoustic transfer characteristic of the screening plate 530 by using a circular screening plate having a diameter "10 cm". FIG. 5 shows a measurement result of the acoustic transfer characteristic of the screening plate 530 by using a circular screening plate having a diameter "12 cm". FIG. 6 shows a measurement result of the acoustic transfer characteristic of the screening plate 530 by using a circular screening plate having a diameter "15 cm". Moreover, these acoustic transfer characteristics are respectively measured at an interval 30° from 0° to 180°. In this case, a position where the loudspeaker 520 is located is on a half circle having a radius "$1.2_m$" centering around a position of the microphone 510. Furthermore, in order to prevent contamination by reflection wave into the microphone 510, this measurement is performed in an anechoic chamber.

As to a principle of the leftward and rightward sound localization, by using an interaural level difference and an interaural time difference (phase difference), this sound localization can be controlled independently from the frontward and rearward sound localization, and the upward and downward sound localization. The interaural level difference is a difference of volume level between audio signals (the third audio signal and the fourth audio signal) presented to both ears of the listener. The interaural time difference is a difference of time between the audio signals presented to both ears of the listener.

Figure 12:
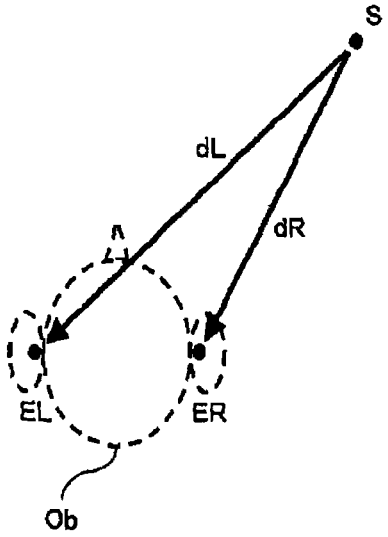
FIG. 12 is a schematic diagram to explain an interaural level difference and an interaural time difference.

FIG. 12 is a schematic diagram to explain the interaural level difference and the interaural time difference. As to a left ear EL and a right ear ER of the listener Ob, the interaural level difference and the interaural time difference are obtained based on a distance dL between the left ear EL and a sound image position S, and a distance dR between the right ear ER and the sound image position S. Here, as the distances dL and dR, by neglecting existence of the pinna and the head of the listener Ob, two straight-line distances from the left ear EL and the right ear ER to the sound image position S are used. Accordingly, the distances dL and dR are calculated by following equation.

$$d_L=\sqrt{(x_{EL}-x_S)^2+(y_{EL}-y_S)^2+(z_{EL}-z_S)^2}$$

$$d_R=\sqrt{(x_{ER}-x_S)^2+(y_{ER}-y_S)^2+(z_{ER}-z_S)^2} \quad (2)$$

$(x_S, y_S, z_S)$: the sound image position S as Cartesian coordinates $(x_{EL}, y_{EL}, z_{EL})$: position of the left ear EL as Cartesian coordinates $(x_{ER}, y_{ER}, z_{ER})$: position of the right ear EL as Cartesian coordinates The interaural level difference is corresponded to a difference of amplitude between sounds propagated from the sound image position S to the left ear EL and the right ear ER. Here, amplitude of sound is in inverse proportion to a distance propagated. The interaural time difference is a difference between times taken for sound to propagate from the sound image position S to the left ear EL and the right ear ER respectively. Here, time taken for sound to propagate is obtained by dividing the propagated distance of sound with the speed of sound.

By using above-mentioned interaural level difference and interaural time difference, a relationship between audio signals (the third audio signal and the fourth audio signal) presented to both ears of the listener and an original audio signal (the second audio signal) is represented as follows.

$$a_L(t) = \frac{A}{d_L} a_S\left(t - \frac{d_L}{c} - \tau\right) \quad (3)$$

$$a_L(t) = \frac{A}{d_L} a_S\left(t - \frac{d_L}{c} - \tau\right)$$

$a_S(t)$: original audio signal (function of time t)

$a_L(t)$: audio signal presented to the left ear of the listener (function of time t)

$a_R(t)$: audio signal presented to the right ear of the listener (function of time t)

A: arbitrary gain

τ: arbitrary time shift amount c: speed of sound

Accordingly, the third audio signal and the fourth audio signal to which the leftward and rightward localization information is assigned are generated by executing amplification processing and time shift processing to the second audio signal to which the frontward and rearward localization information is assigned.

Hereinafter, component of the sound localization apparatus of FIG. 1 is explained in detail.

The storage unit 10 stores the acoustic transfer characteristics shown in FIGS. 2~6. Concretely, the storage unit 10 stores an acoustic transfer characteristic set of five kinds. The acoustic transfer characteristic set includes acoustic transfer characteristics corresponding to a plurality of sound image directions. These acoustic transfer characteristics are obtained from circular screening plates (Hereinafter, they are called "disks") of which sizes (Hereinafter, they are called "diameters") are different for each acoustic transfer characteristic set. In the first embodiment, as shown in FIGS. 2~6, the storage unit 10 stores five acoustic transfer characteristic sets obtained from five disks of which diameters are 4 cm, 7 cm, 10 cm, 12 cm and 15 cm. In each set, seven acoustic transfer characteristics corresponding to sound image directions 0°, 30°, 60°, 90°, 120°, 150° and 180° are included. Moreover, the storage unit 10 may store data of the acoustic transfer characteristic subjected to inverse Fourier transform.

Here, a relationship between a diameter of the disk and an emphasis degree of the sound image localization is explained.

Figure 7:
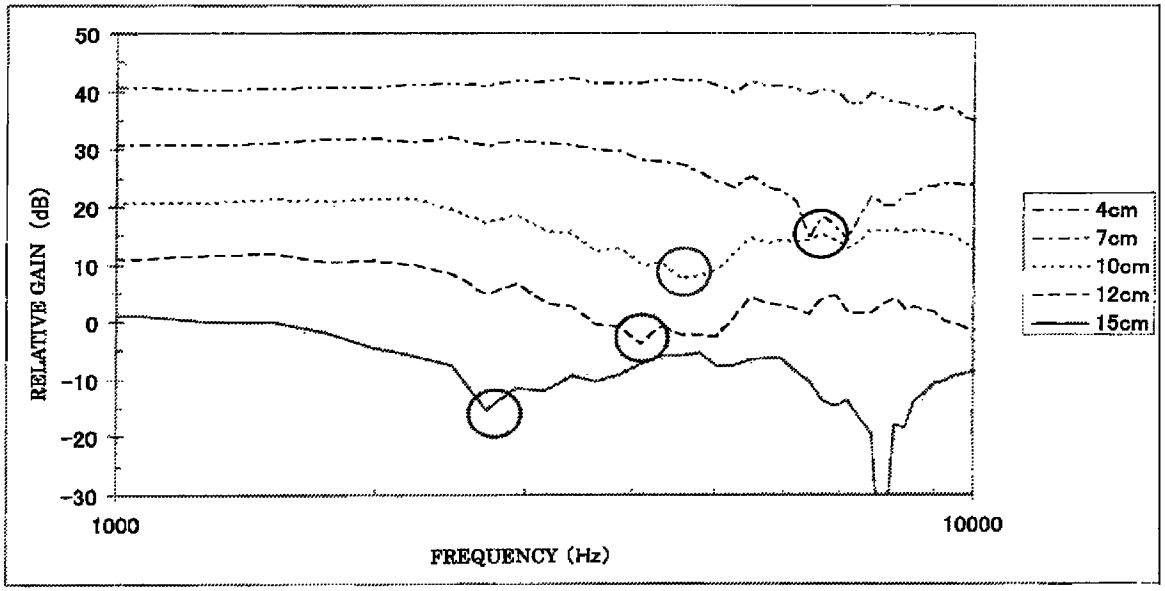
FIG. 7 is a graph showing a comparison result due to difference of diameters of disks for the acoustic transfer characteristic according to the first embodiment.

FIG. 7 is a comparison graph showing difference among acoustic transfer characteristics due to diameters of disks corresponding to the same direction (150°) of the loudspeaker. As shown in FIG. 7, if the diameter is larger, a dip (○ in FIG. 7) at the lowest frequency side is shifted to lower frequency side. Accordingly, a position (frequency) of the dip in the acoustic transfer characteristic represents the difference due to diameters of disks.

Figure 8:
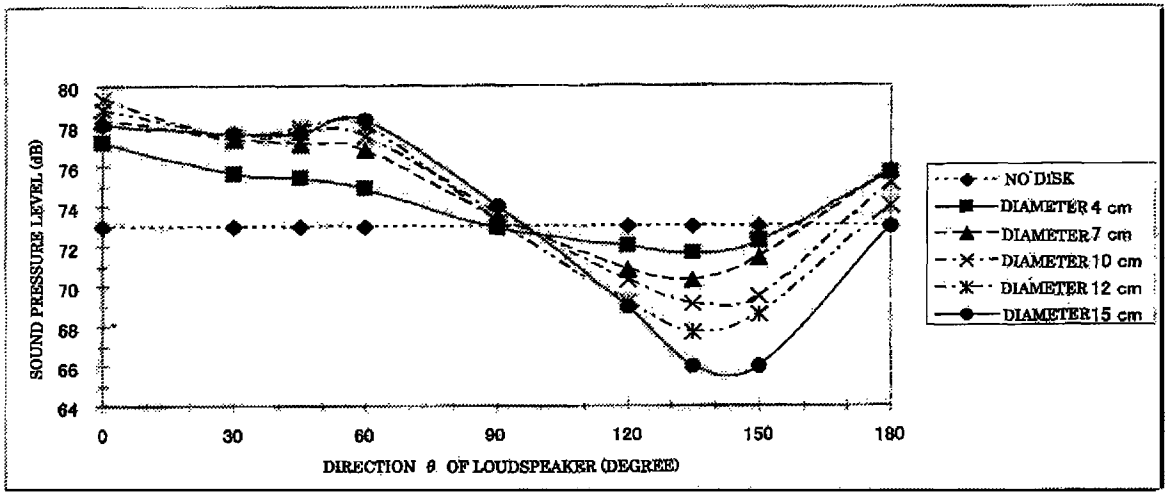
FIG. 8 is a graph showing a comparison result due to difference of diameters of disks for a sound pressure level adjacent to a center of the disk.

Furthermore, FIG. 8 is a graph showing examples of a sound pressure level adjacent to a center of the disk. Here, a volume of the loudspeaker is adjusted so that the sound pressure level at a position of the microphone is 73 dB under a condition that the disk is not located.

As shown in FIG. 8, by effect of the disk, when the direction θ of the loudspeaker is the front 0°~90°, the sound pressure level increases. On the other hand, when the direction θ of the loudspeaker is the rear 90°~180°, the sound pressure level decreases. Furthermore, if the diameter of the disk is larger, this effect is larger, and a change amount of the sound pressure level is also larger. Especially, at the rear 90°~180°, a notable effect is shown.

This change amount of the sound pressure level is regarded to affect on the emphasis degree of feeling of localization of the sound image. Accordingly, in order to adjust the emphasis degree of feeling of localization, the sound pressure level corresponding to the same sound image direction had better be changed. Briefly, by suitably selecting the acoustic transfer characteristic obtained from disks having different diameters corresponding to the same sound image direction, the emphasis degree of feeling of localization can be adjusted.

Moreover, in the first embodiment, the storage unit 10 stores five acoustic transfer characteristic sets obtained from five disks having diameters 4 cm, 7 cm, 10 cm, 12 cm and 15 cm. However, the storage unit 10 may store at least two acoustic transfer characteristic sets obtained from two disks. Furthermore, the diameter of the disk (frequency of the dip) can be suitably selected so that the frequency of the dip is included in a human's audible frequency area (for example, 20 Hz~20 kHz).

More preferably, as a diameter of the disk (frequency of dip), by setting a size d of the listener's ear to a reference, scale factors n1 and n2 (n1<n2) for the size d are indicated. Here, a frequency corresponding to a length d×n1 is a upper threshold, and a frequency corresponding to a length d×n2 is a lower threshold. By setting a range having the upper threshold and the lower threshold, the diameter can be suitably selected so that the frequency of dip is included in the range.

Moreover, the scale factor can be previously examined by a questionnaire as a range that an emphasis degree of feeling of localization effectively acts on the sense of hearing of human. For example, when a screening plate having a size from a half (diameter 2 cm) to four times (diameter 16 cm) of the size of ear is used, the frequency range is approximately 2 kHz~17 kHz. As a result, when the frequency of dip is equal to a frequency corresponding to the size d of ear, by setting the emphasis degree (the regular feeling) of feeling of localization to a reference, the emphasis degree of feeling of localization can be relatively adjusted to the reference for each listener.

Based on direction indication information and emphasis degree indication information, the selection unit 20 selects an acoustic transfer characteristic most suitable for each information (the direction indication information, the emphasis degree indication information) from the storage unit 10.

Here, the direction indication information is used for indicating a direction of sound image to be presented to the listener. Concretely, the direction indication information includes an angle representing a sound image direction. For example, in contents such as movie or game, by previously recording the sound image direction to be presented to listeners into a contents recording medium (by a contents producer), the direction indication information as the sound image information is obtained from the contents recording medium. Furthermore, for example, in a service for a listener to freely indicate the sound image direction, by indicating via the input unit 50 from the listener, the direction indication information can be obtained therefrom.

Furthermore, the emphasis degree indication information is used for indicating the emphasis degree of feeling of localization of sound image. For example, the emphasis degree can be sectioned into five levels (1, 2, 3, 4, 5) from low level to high level. The emphasis degree indication information can be obtained by inputting the level matched with the listener's liking via the input unit 50 from the listener.

The level of the emphasis degree is corresponded to a diameter of the disk (frequency of dip). Briefly, in the first embodiment, an acoustic transfer characteristic set obtained from the disk having diameter 4 cm is corresponded to level 1. An acoustic transfer characteristic set obtained from the disk having diameter 7 cm is corresponded to level 2. An acoustic transfer characteristic set obtained from the disk having diameter 10 cm is corresponded to level 3. An acoustic transfer characteristic set obtained from the disk having diameter 12 cm is corresponded to level 4. An acoustic transfer characteristic set obtained from the disk having diameter 15 cm is corresponded to level 5.

The selection unit 20 obtains the emphasis degree indication information from the input unit 50, and selects the acoustic transfer characteristic set corresponding to the level indicated by the emphasis degree indication information from the storage unit 10. Furthermore, the selection unit 20 obtains the direction indication information from the input unit 50, and selects an acoustic transfer characteristic most suitable for the sound image direction indicated by the direction indication information from the acoustic transfer characteristic set selected. Here, a suitable acoustic transfer characteristic is defined as follows.

Briefly, if the storage unit 10 stores an acoustic transfer characteristic corresponding to the sound image direction indicated by the direction indication information, this acoustic transfer characteristic is called the suitable acoustic transfer characteristic.

Furthermore, if the storage unit 10 does not store the acoustic transfer characteristic corresponding to the sound image direction indicated by the direction indication information, an acoustic transfer characteristic (stored in the storage unit 10) corresponding to a sound image direction having the smallest difference from the sound image direction indicated by the direction indication information is called the suitable acoustic transfer characteristic. In this case, if the storage unit 10 stores a plurality of acoustic transfer characteristics each having the smallest difference, for example, an acoustic transfer characteristic corresponding to the most rear direction (nearest to 180°) is selected as the suitable acoustic transfer characteristic. Furthermore, among acoustic transfer characteristics stored in the storage unit 10, by using two acoustic transfer characteristics corresponding to two sound image directions nearest to the sound image direction indicated by the direction indication information, an acoustic transfer characteristic created by interpolating the two acoustic transfer characteristics may be called the suitable acoustic transfer characteristic.

The first operation unit 30 obtains a suitable acoustic transfer characteristic selected by the selection unit 20. By convoluting the suitable acoustic transfer characteristic with an audio signal (the first audio signal) inputted externally, the first operation unit 30 obtains an audio signal (the second audio signal) to which the frontward and rearward localization information is assigned. For example, as a following equation, by inputting the audio signal to a FIR (Finite Impulse Response) filter to which Inverse Fourier Transform of the acoustic transfer characteristic is set as filter coefficient of each tap, the first operation unit 30 can operate convolution.

$$y[n] = \sum_{k=0}^{N-1} h[k]x[n-k] \tag{4}$$

x[n]: input signal
y[n]: output signal
h[n]: filter coefficient
N: tap length

Based on distance indication information, the second operation unit 40 assigns an interaural level difference and an interaural time difference to the audio signal (the second audio signal) obtained by the first operation unit 30, and obtains an audio signal (the third audio signal) for left ear and an audio signal (the fourth audio signal) for right ear.

Here, the distance indication information is used for indicating a distance (sound image distance) of a sound image to be presented to the listener. Concretely, the distance indication information includes a distance dL between a sound image position and the left ear, a distance dR between the sound image position and the right ear, a gain A, and a time shift amount τ.

Moreover, dL and dR may be previously calculated based on a distance between both ears of the listener or an average listener. Furthermore, the gain A and the time shift amount τ may be arbitrarily determined, or adjusted to be matched with the listener's liking by using the input unit 50.

The second operation unit 40 obtains the audio signal (the second audio signal) from the first operation unit 30 and the distance indication information from the input unit 50. Then, the second operation unit 40 calculates an audio signal $a_L$ (the third audio signal) for left ear and an audio signal $a_R$ (the fourth audio signal) for right ear by the equation (3).

The output unit 60 outputs the third audio signal and the fourth audio signal (calculated by the second operation unit 40) to the listener. When the third audio signal and the fourth audio signal are directly presented to the right and left ears of the listener, for example, the output unit 60 can use a headphone or an earphone.

Furthermore, a loudspeaker can be used as the output unit 60. Here, the loudspeaker is remote from the ears of the listener, and the third audio signal and the fourth audio signal cannot be directly presented to the right and left ears of the listener. In this case, by using a plurality of loudspeakers, sounds radiated from the plurality of loudspeakers are transferred to the right and left ears of the listener, and overlapped. Accordingly, the third audio signal and the fourth audio signal are converted so that the overlapped result is matched with the third audio signal and the fourth audio signal, and outputted via the plurality of loudspeakers. As the method for converting the third audio signal and the fourth audio signal, conventional technique can be used.

Figure 9:
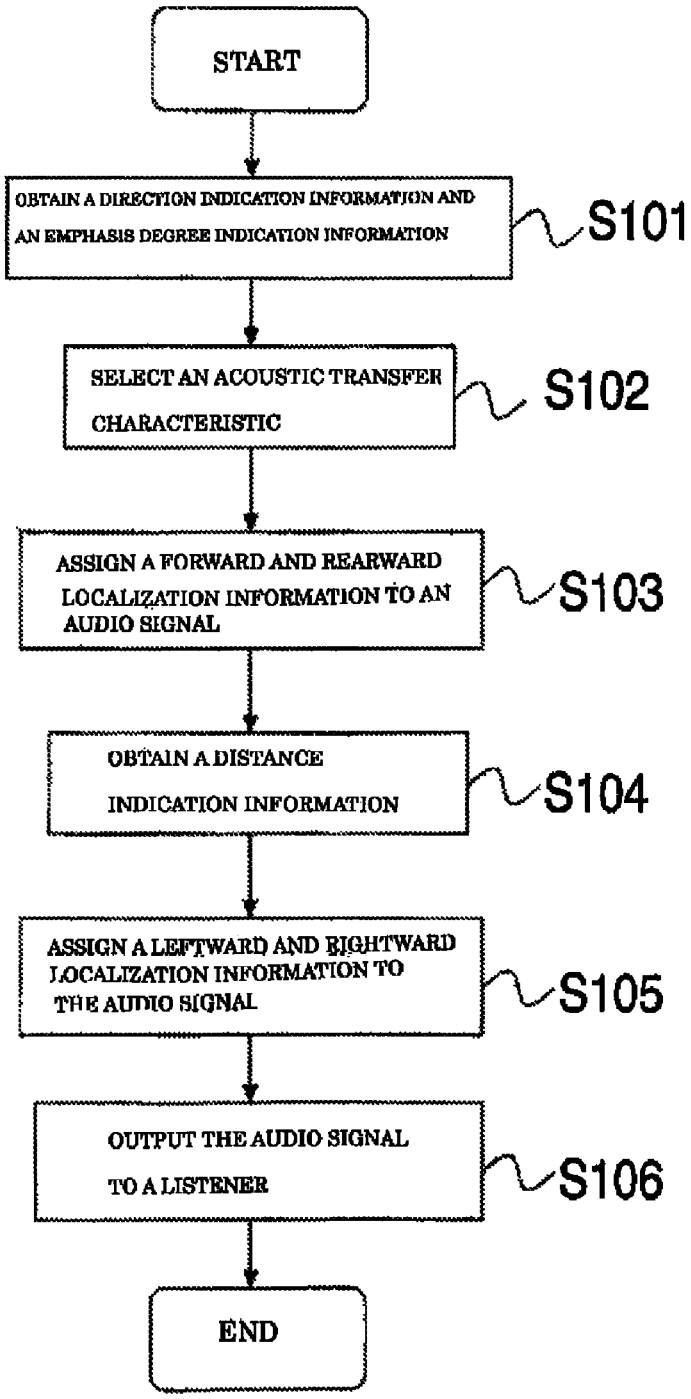
FIG. 9 is a flow chart of a sound localization method according to the first embodiment.

FIG. 9 is a flow chart to explain the sound localization method.

The selection unit 20 obtains the direction indication information and the emphasis degree indication information from the input unit 50 (S101). By using the direction indication information and the emphasis degree indication information, the selection unit 20 selects any of a plurality of acoustic transfer characteristics stored in the storage unit 10 (S102).

By using an acoustic transfer characteristic selected by the selection unit 20, the first operation unit 30 convolutes the acoustic transfer characteristic with an audio signal, and obtains the audio signal to which the frontward and rearward localization information is assigned (S103).

The second operation unit 40 obtains the distance indication information from the input unit 50 (S104). By using the distance indication information, the second operation unit 40 assigns the interaural level difference and the interaural time difference to the audio signal (obtained at S103), and obtains a pair of audio signals to which the leftward and rightward localization information is assigned (S105).

The output unit 60 outputs the audio signals (obtained at S105) to the listener (S106).

According to the sound image localization apparatus and the method thereof, the emphasis degree of feeling of localization of sound image can be easily adjusted.

The Second Embodiment

Figure 10:
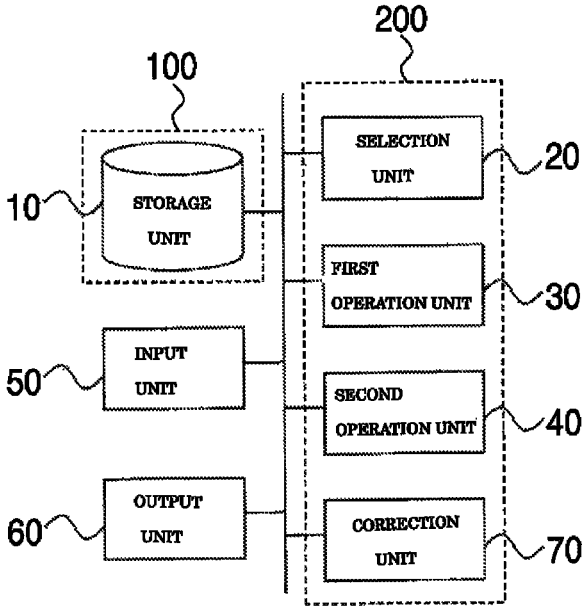
FIG. 10 is a block diagram of the sound localization apparatus according to a second embodiment.

FIG. 10 is a block diagram of the sound image localization apparatus according to the second embodiment. In FIG. 10, the sound image localization apparatus further includes a correction unit 70. This unit is different from the sound image localization apparatus of FIG. 1.

When the acoustic transfer characteristic is used, the direction θ of the loudspeaker where the sound pressure level minimized is rarely just 180°. In case of the disk, as shown in FIG. 8, the sound pressure level is minimized at a direction range "θ=130°~150°".

On the other hand, in the human's sense of hearing, when the sound image direction is rearward 180°, the sound pressure level is minimized. The largest reason to occur this difference is, while the human's pinna is accompanied with the head, the screening plate to imitate the pinna is isolated in space. Briefly, when the acoustic transfer characteristic is measured, if the direction θ of the loudspeaker is rearward 180°, the loudspeaker 520, the screening plate 530 and the microphone 510 are aligned in a straight line. In this case, sound waves going around the screening plate 530 are overlapped at a position of the microphone 510, and the sound pressure level thereof is not minimized. On the other hand, when sound arrives from just behind the human, sounds going around the pinna are interrupted by the head, and not overlapped. As a result, the sound pressure level thereof is minimized.

In order to correct above-mentioned difference, the correction unit 70 corrects a sound image direction included in the direction indication information to minimize the sound pressure level at the sound image direction 180°. Concretely, by using the sound image direction ϕ included in the direction indication information, the correction unit 70 calculates a sound image direction θ corrected according to a following equation. Moreover, as the sound image direction $\theta_0$, by previously examining the direction of the loudspeaker where the sound pressure level is minimized, this direction of the loudspeaker can be previously stored in the storage unit 10. In the second embodiment, for example, the direction $\theta_0$ of the loudspeaker is 140°.

$$\theta = \frac{\theta_0}{180}\phi \tag{5}$$

θ: corrected sound image direction=direction of loudspeaker in acoustic transfer characteristic ϕ: sound image direction (0°~180° included in direction indication information $\theta_0$: direction of loudspeaker where sound pressure level is minimized in acoustic transfer characteristic Based on the sound image direction θ corrected by the correction unit 70, the selection unit 20 selects an acoustic transfer characteristic from the storage unit 10.

According to the sound image localization apparatus of the second embodiment, when the sound image direction is rearward 180°, the sound pressure level is minimized. Accordingly, frontward and rearward sound localization processing suitable for the human's sense of hearing can be executed.

(Modification)

As the acoustic transfer characteristic, information of a part of frequency band may be used. For example, as to a sound having a wavelength sufficiently longer than a size of the screening plate, this sound is hardly influenced by existence of the screening plate, and a value of the acoustic transfer characteristic is almost equal to 1 (0 dB) in low frequency. Accordingly, the acoustic transfer characteristic may not include information of low frequency component (For example, below 500 Hz).

Furthermore, for example, a frequency component near an upper limit (approximately, 20 kHz) of human's audible frequency is not often included in the audio signal. In addition to this, by poor performance of the loudspeaker or the microphone used for measuring an acoustic transfer characteristic, the acoustic transfer characteristic of such frequencies cannot be accurately measured. Accordingly, the acoustic transfer characteristic may not include information of high frequency component (For example, above 17 kHz).

In the sound image localization apparatus according to the modification of the first embodiment or the second embodiment, the storage unit 10 stores the acoustic transfer characteristic of only a part (500 Hz~17 kHz) of a frequency band.

The first operation unit 30 convolutes the acoustic transfer characteristic (stored in the storage unit 10) of only a part (500 Hz~17 kHz) of the frequency band with the audio signal.

As a result, information amount of frequency characteristics of the acoustic transfer characteristic (stored in the storage unit 10) can be reduced, and hardware resources for storing can be saved. Furthermore, the audio signal's frequency component unnecessary for sound image localization processing is outputted without the processing. Accordingly, unnecessary degradation of the quality of the audio signal can be prevented.

According to the sound image localization apparatus of at least one of above-mentioned embodiments, the emphasis degree of feeling of localization of sound image can be easily adjusted.

In the disclosed embodiments, the processing can be performed by a computer program stored in a computer-readable medium.

In the embodiments, the computer readable medium may be, for example, a magnetic disk, a flexible disk, a hard disk, an optical disk (e.g., CD-ROM, CD-R, DVD), an optical magnetic disk (e.g., MD). However, any computer readable medium, which is configured to store a computer program for causing a computer to perform the processing described above, may be used.

Furthermore, based on an indication of the program installed from the memory device to the computer, OS (operating system) operating on the computer, or MW (middle ware software), such as database management software or network, may execute one part of each processing to realize the embodiments.

Furthermore, the memory device is not limited to a device independent from the computer. By downloading a program transmitted through a LAN or the Internet, a memory device in which the program is stored is included. Furthermore, the memory device is not limited to one. In the case that the processing of the embodiments is executed by a plurality of memory devices, a plurality of memory devices may be included in the memory device.

A computer may execute each processing stage of the embodiments according to the program stored in the memory device. The computer may be one apparatus such as a personal computer or a system in which a plurality of processing apparatuses are connected through a network. Furthermore, the computer is not limited to a personal computer. Those skilled in the art will appreciate that a computer includes a processing unit in an information processor, a microcomputer, and so on. In short, the equipment and the apparatus that can execute the functions in embodiments using the program are generally called the computer.

While certain embodiments have been described, these embodiments have been presented by way of examples only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An apparatus for localizing a sound image, comprising:

a storage unit to store a plurality of acoustic transfer characteristics corresponding to respective different combinations of a sound image direction and an emphasis degree of feeling of localization, the emphasis degree representing a change amount of a sound pressure level of a virtual sound heard along the sound image direction if the sound image direction changes;

an input unit that receives direction indication information and emphasis degree indication information from a listener;

a selection unit that selects a suitable acoustic transfer characteristic from the plurality of acoustic transfer characteristics, the suitable acoustic transfer characteristic being determined by the selection unit to be most matched with the sound image direction indicated by the direction indication information and the emphasis degree indicated by the emphasis degree indication information;

a first operation unit that convolutes the suitable acoustic transfer characteristic with a first audio signal to obtain a second audio signal;

a second operation unit that calculates a phase difference and a level difference by using distance indication information to indicate a distance of the sound image, and obtains a third audio signal and a fourth audio signal by assigning the phase difference and the level difference to the second audio signal; and an output unit that outputs the third audio signal and the fourth audio signal.

2. The apparatus according to claim 1, wherein the storage unit stores a first acoustic transfer characteristic set including a first acoustic transfer characteristic corresponding to a first sound image direction and having a dip at a first frequency, and a second acoustic transfer characteristic corresponding to a second sound image direction and having a dip at a second frequency, and a second acoustic transfer characteristic set including a third acoustic transfer characteristic corresponding to the first sound image direction and having a dip at a third frequency lower than the first frequency, and a fourth acoustic transfer characteristic corresponding to the second sound image direction and having a dip at a fourth frequency lower than the second frequency, and the selection unit selects one of the first acoustic transfer characteristic set or the second acoustic transfer characteristic set by using the emphasis degree indication information to yield a selected acoustic transfer characteristic set, and selects the suitable acoustic transfer characteristic corresponding to the sound image direction indicated by the direction indication information from the selected acoustic transfer characteristic set.

3. The apparatus according to claim 1, wherein the first operation unit convolutes the suitable acoustic transfer characteristic of a part of a frequency band with the first audio signal.

4. A method for localizing a sound image, comprising:

storing a plurality of acoustic transfer characteristics corresponding to respective different combinations of a sound image direction and an emphasis degree of feeling of localization into a storage unit, the emphasis degree representing a change amount of a sound pressure level of a virtual sound heard along the sound image direction if the sound image direction changes;

inputting direction indication information and emphasis degree indication information by a listener;

selecting a suitable acoustic transfer characteristic from the plurality of acoustic transfer characteristics, wherein the selecting is based on a determination that the suitable acoustic transfer characteristic is most matched with the sound image direction indicated by the direction indication information and the emphasis degree indicated by the emphasis degree indication information;

convoluting the suitable acoustic transfer characteristic with a first audio signal to obtain a second audio signal;

calculating a phase difference and a level difference by using distance indication information to indicate a distance of the sound image;

obtaining a third audio signal and a fourth audio signal by assigning the phase difference and the level difference to the second audio signal; and outputting the third audio signal and the fourth audio signal.

5. The method according to claim 4, further comprising:

calculating a phase difference and a level difference by using distance indication information to indicate a distance of the sound image; and obtaining a third audio signal and a fourth audio signal by assigning the phase difference and the level difference to the second audio signal.

6. A non-transitory computer readable medium for causing a computer to perform a method for localizing a sound image, the method comprising:

storing a plurality of acoustic transfer characteristics corresponding to respective different combinations of a sound image direction and an emphasis degree of feeling of localization into a storage unit, the emphasis degree representing a change amount of a sound pressure level of a virtual sound heard along the sound image direction if the sound image direction changes;

inputting direction indication information and emphasis degree indication information by a listener;

selecting a suitable acoustic transfer characteristic from the plurality of acoustic transfer characteristics, the suitable acoustic transfer characteristic determined to be most matched with the sound image direction indicated by the direction indication information and the emphasis degree indicated by the emphasis degree indication information;

convoluting the suitable acoustic transfer characteristic with a first audio signal to obtain a second audio signal;

calculating a phase difference and a level difference by using distance indication information to indicate a distance of the sound image;

obtaining a third audio signal and a fourth audio signal by assigning the phase difference and the level difference to the second audio signal; and outputting the third audio signal and the fourth audio signal.

* * * * *